US011661769B2

(12) United States Patent
Miwa

(10) Patent No.: US 11,661,769 B2
(45) Date of Patent: May 30, 2023

(54) EMERGENCY RELEASE DEVICE OF LOCK SYSTEM

(71) Applicant: SHIROKI CORPORATION, Fujisawa (JP)

(72) Inventor: Masashi Miwa, Toyokawa (JP)

(73) Assignee: AISIN CORPORATION, Kariya (JP)

( * ) Notice: Subject to any disclaimer, the term of this patent is extended or adjusted under 35 U.S.C. 154(b) by 923 days.

(21) Appl. No.: 16/259,479

(22) Filed: Jan. 28, 2019

(65) Prior Publication Data

US 2019/0234119 A1 Aug. 1, 2019

(30) Foreign Application Priority Data

Jan. 29, 2018 (JP) ..... JP2018-012487

(51) Int. Cl.
*E05B 83/26* (2014.01)
*E05B 83/18* (2014.01)
*E05B 85/10* (2014.01)

(52) U.S. Cl.
CPC ..... *E05B 83/26* (2013.01); *E05B 85/10* (2013.01); *E05B 83/18* (2013.01)

(58) Field of Classification Search
CPC ..... E05B 83/26; E05B 83/18; E05B 13/002; E05B 13/007; E05B 17/2019; E05B 17/2015; E05B 17/203; E05B 17/2034; E05B 15/008; E05B 15/0053; E05B 85/10; Y10S 292/38; Y10S 292/42; Y10S 292/43; Y10S 292/65
See application file for complete search history.

(56) References Cited

U.S. PATENT DOCUMENTS 6,092,845 A * 7/2000 Koenig ..... E05B 83/16 292/DIG. 43
6,364,379 B1 * 4/2002 Roberts ..... E05B 83/16 292/216

(Continued)

FOREIGN PATENT DOCUMENTS

CA 2324720 A1 * 4/2002 ..... E05B 83/16
DE 10158733 A1 * 2/2003 ..... E05B 85/10

(Continued)

OTHER PUBLICATIONS

Merriam-Webster.com Dictionary, s.v. "spring," accessed Aug. 24, 2022, https://www.merriam-webster.com/dictionary/spring. (Year: 2022).*

(Continued)

*Primary Examiner* — Christine M Mills
*Assistant Examiner* — Emily G. Brown
(74) *Attorney, Agent, or Firm* — Buchanan Ingersoll & Rooney PC

(57) ABSTRACT

To provide an emergency release device of a lock system capable of opening a trunk lid using an emergency release lever, the emergency release lever is manipulatable between a first position for placing a pawl in an engagement position and a second position for placing the pawl in a non-engagement position from the inner side of the trunk and is biased toward the first position. An anti-return mechanism prevents the emergency release lever from returning from the second position to the first position when the emergency release lever is manipulated from the first position to the second position.

4 Claims, 10 Drawing Sheets

(56) References Cited

U.S. PATENT DOCUMENTS

| | | | | |
|---|---|---|---|---|
| 9,309,699 | B2 * | 4/2016 | Tamura | E05B 81/42 |
| 2001/0005081 | A1 * | 6/2001 | Takahashi | E05B 83/26 292/336 |
| 2004/0163487 | A1 * | 8/2004 | Martus | E05B 1/00 74/502.2 |
| 2012/0032456 | A1 | 2/2012 | Ishikawa et al. | |
| 2013/0140831 | A1 * | 6/2013 | Kempel | E05B 83/26 292/3 |
| 2017/0058573 | A1 | 3/2017 | Kurita et al. | |
| 2017/0350172 | A1 * | 12/2017 | Tamura | E05B 81/34 |

FOREIGN PATENT DOCUMENTS

| | | | |
|---|---|---|---|
| JP | 2012036579 | A | 2/2012 |
| JP | 2015158040 | A | 9/2015 |

OTHER PUBLICATIONS

Merriam-Webster.com Dictionary, s.v. "vicinity," accessed Aug. 25, 2022, https://www.merriam-webster.com/dictionary/vicinity. (Year: 2022).*

* cited by examiner

EMERGENCY RELEASE DEVICE OF LOCK SYSTEM

FIELD OF THE INVENTION

Embodiments described herein relate generally to an emergency release device of a lock system.

BACKGROUND OF THE INVENTION

Patent Document 1 discusses a lock mechanism for locking a trunk lid (openable/closable body) by engaging a hook with a ratchet and unlocking the trunk lid by disengaging the hook from the ratchet. When the trunk lid is unlocked by disengaging the hook from the ratchet, the trunk lid pops up by virtue of a reactive force of a pop-up lever or a weather strip, and the hook is released from the striker, so that the trunk lid is opened.

Patent Document 2 discusses an emergency release lever interlocking with the lock mechanism and manipulatable between an initial position where the hook and the ratchet are engaged and a pulled position where the hook and the ratchet are disengaged. The emergency release lever is installed inside the trunk lid. In a case where the trunk lid is erroneously closed while a person exists inside, the trapped person can open the trunk lid by pulling the emergency release lever to manipulate the emergency release lever from the initial position to the pulled position.

In the prior art described above, the trunk lid may be driven to be opened or closed by a drive mechanism in some cases. The drive mechanism has, for example, an expansion/contraction drive unit provided with one end and the other end installed in the main body and the trunk lid, and driven to expand or contract using the drive motor.

CITATION LIST

Patent Documents

Patent Document 1: Japanese Unexamined Patent Application Publication No. 2015-158040

Patent Document 2: Japanese Unexamined Patent Application Publication No. 2012-036579

SUMMARY OF THE INVENTION

However, in a case where a battery of the drive motor is bulged out while the trunk lid is fully closed, the trunk lid does not pop up, the hook is not released from the striker, and the trunk lid is not opened due to a holding force (sliding resistance) of the expansion/contraction drive unit even by pulling the emergency release lever. That is, the hook is not released from and stays in the striker even by pulling the emergency release lever and disengaging the ratchet from the hook. Therefore, the ratchet and the hook are re-engaged immediately after the emergency release lever is released, so that it is difficult to open the trunk lid. This technical problem similarly applies to a case where the trunk lid does not pop up, the hook is not released from the striker, and the trunk lid is not opened due to freezing in a cold weather or the like.

In view of the aforementioned problems, it is therefore an object of the invention to provide an emergency release device of a lock system, capable of opening the trunk lid using the emergency release lever.

According to an embodiment of the invention, there is provided an emergency release device of a lock system provided in one of a rim of a trunk formed in a vehicle body and a lid that opens or closes the trunk and locked to or unlocked from a striker provided in another one, the emergency release device including: a hook having a groove where the striker is insertable, the hook being rotatable from an unlock position where the striker is insertable into the groove to a lock position in which the striker is inhibited from being released from the groove; a pawl rotatable between an engagement position where the pawl is engaged with the hook placed in the lock position to inhibit rotation of the hook to an unlock direction and a non-engagement position where the pawl is not engaged with the hook, the pawl being biased toward the engagement position; an emergency release lever manipulatable from an inner side of the trunk between a first position for placing the pawl in the engagement position and a second position for placing the pawl in the non-engagement position, the emergency release lever being biased toward the first position; and an anti-return mechanism configured to prevent the emergency release lever from returning from the second position to the first position when the emergency release lever is manipulated from the first position to the second position.

The lock system may have a housing member configured to house the emergency release lever in the first position and a connecting member connected to the emergency release lever to directly or indirectly pivot the pawl from the engagement position to the non-engagement position by manipulating the emergency release lever from the first position to the second position. The anti-return mechanism may have an engagement portion supported by the connecting member and an engagement target portion supported by the housing member, and the emergency release lever may be held in the second position by engaging the engagement portion with the engagement target portion.

The lock system may have a housing member configured to house the emergency release lever in the first position and a connecting member connected to the emergency release lever to directly or indirectly pivot the pawl from the engagement position to the non-engagement position by manipulating the emergency release lever from the first position to the second position. The anti-return mechanism may have an elastic member supported by the connecting member and provided between the housing member and the emergency release lever, and the elastic member may be in a compressed state when the emergency release lever is in the first position. The elastic member may be in a free state, and the emergency release lever may be held in the second position when the emergency release lever is manipulated from the first position to the second position.

According to the present invention, it is possible to obtain an emergency release device of a lock system, capable of opening the trunk lid using the emergency release lever.

DESCRIPTION OF EMBODIMENTS

A power trunk lid 1 having an emergency release device of a lock system according to an embodiment of the invention will now be described in details with reference to FIGS. 1 to 10.

Figure 1:
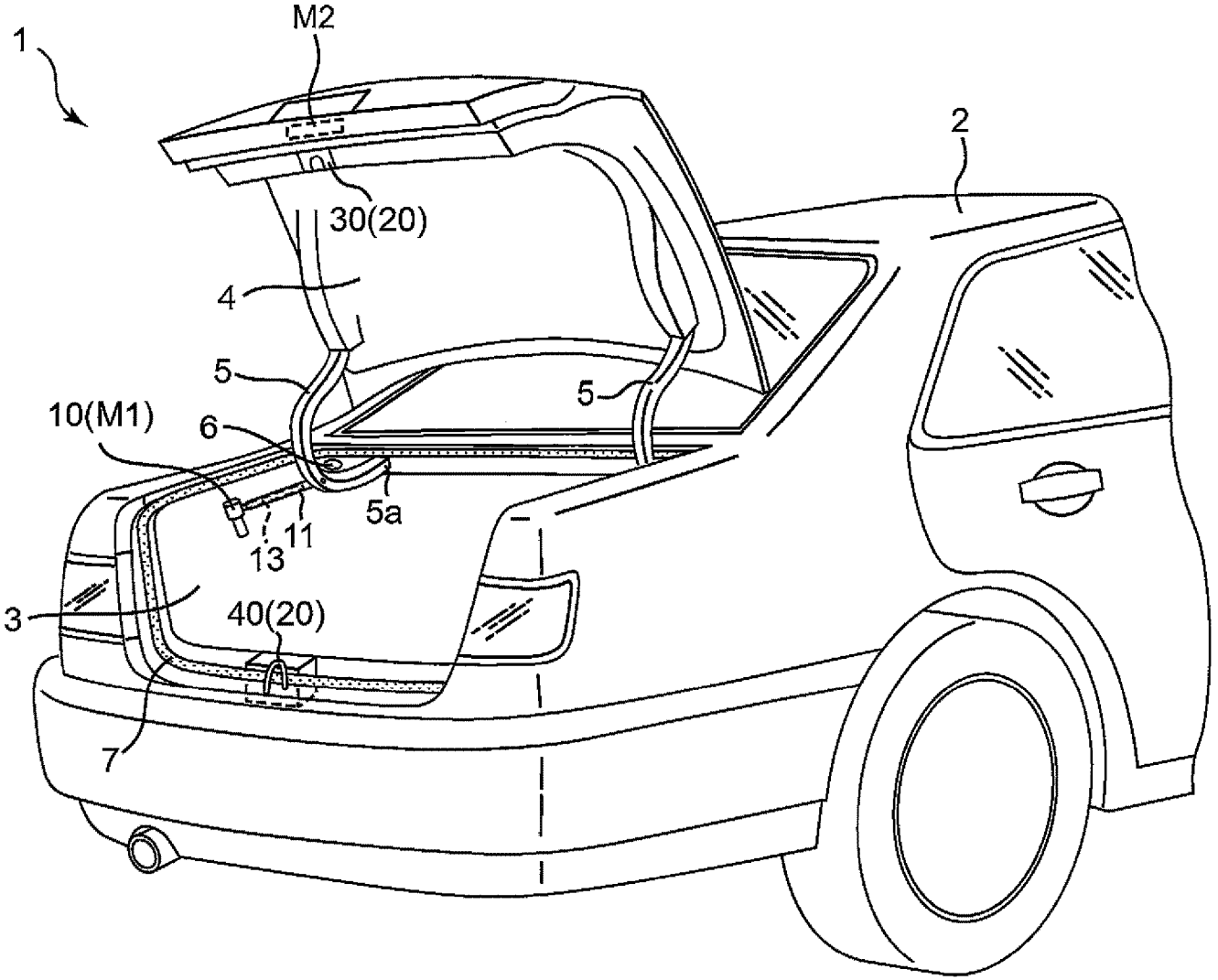
FIG. 1 is a perspective view illustrating a configuration of a power trunk lid having an emergency release device of a lock system according to an embodiment of the invention.
Figure 2:
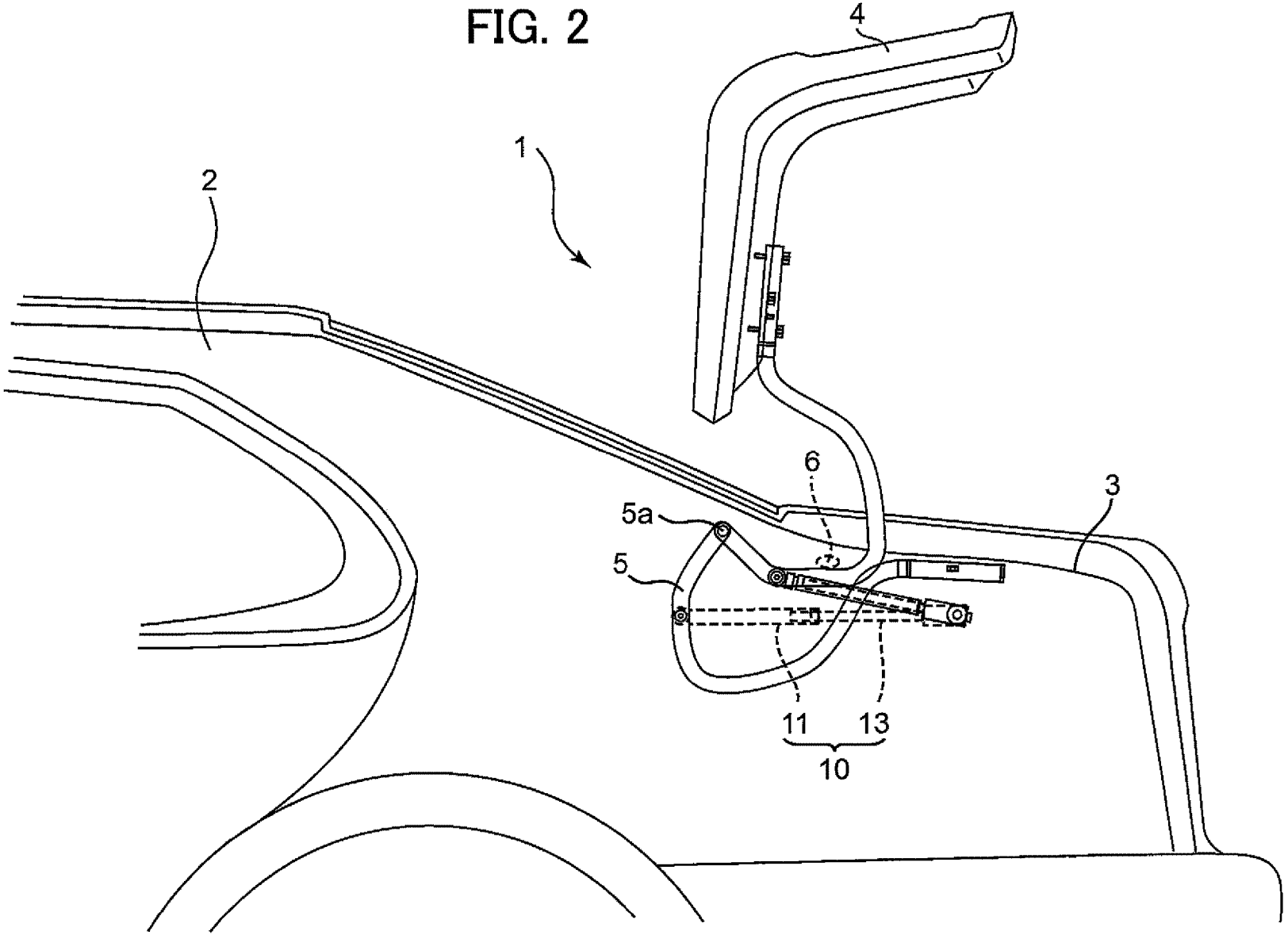
FIG. 2 is a cross-sectional view illustrating an open/close operation of the power trunk lid of FIG. 1.

As illustrated in FIGS. 1 and 2, the power trunk lid 1 is to make a trunk (trunk opening) 3 provided in a vehicle body 2 openable or closable by a trunk lid (lid) 4. The trunk lid 4 is pivotally installed in the vehicle body 2 using a pair of hinge members 5 provided in both sides of a vehicle left-right direction and is openable or closable with respect to a pivot shaft 5*a* of the hinge member 5. A pair of stopper members 6 respectively abutting on a pair of hinge members 5 in a fully opened position of the trunk lid 4 are provided in the vehicle left-right direction of the trunk 3 of the vehicle body 2 to match a pair of hinge members 5 of the trunk lid 4. A weather strip 7 elastically deformed between the vehicle body 2 and the trunk lid 4 in a fully closed position of the trunk lid 4 to prevent water from flowing to the trunk 3 is provided along the entire periphery of the edge of the trunk 3 of the vehicle body 2.

Figure 3:
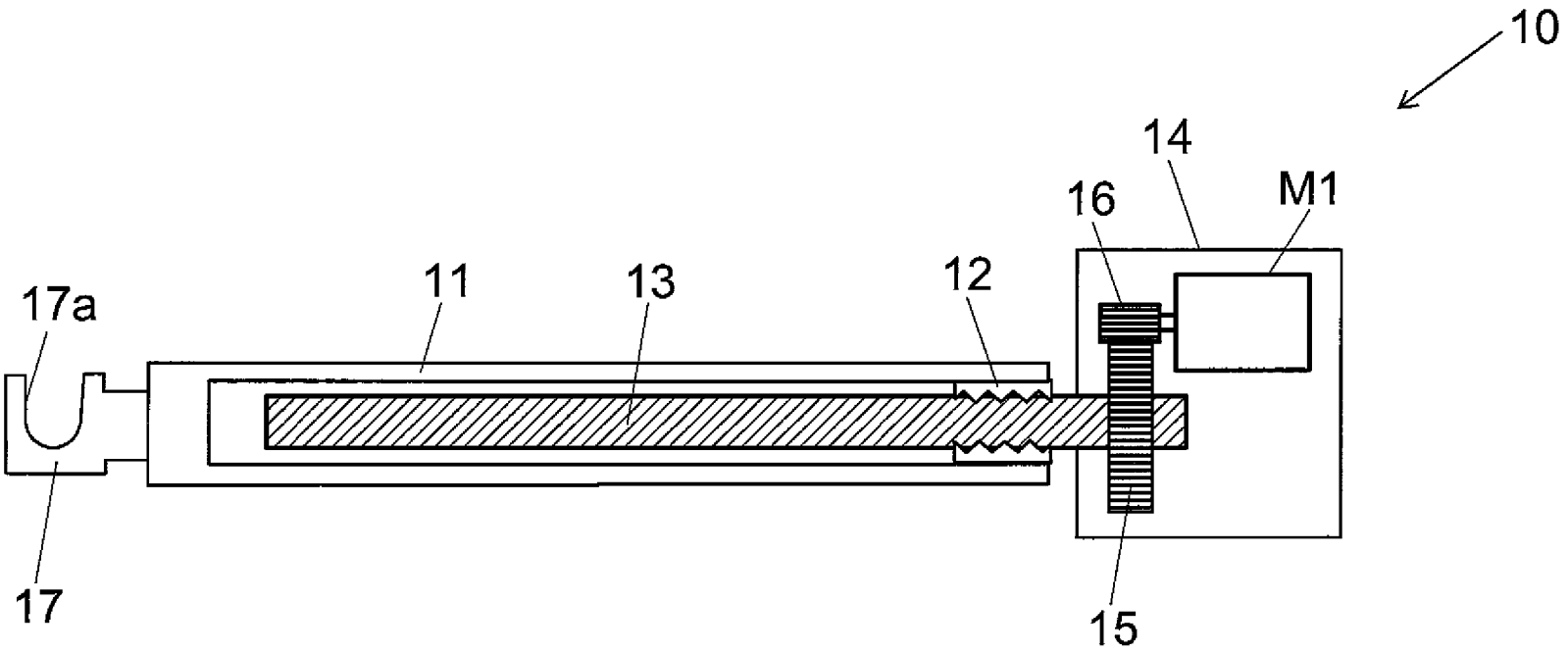
FIG. 3 is a conceptual diagram illustrating a configuration of an expansion/contraction drive unit.

As illustrated in FIGS. 1 to 3, the power trunk lid 1 has an expansion/contraction drive unit 10 that openably/closably drives the trunk lid 4. The expansion/contraction drive unit 10 has one end and the other end pivotally installed in a wall surface of the trunk 3 of the vehicle body 2 and the hinge member 5 of the trunk lid 4 for expansion/contraction driving using a trunk drive motor M1.

As illustrated in FIG. 3, the expansion/contraction drive unit 10 has a bottomed cylindrical outer tube 11, a spindle nut 12 provided in the vicinity of an opening separated from a bottom of the inner tubular surface of the outer tube 11, and a spindle thread portion 13 screwed to the spindle nut 12 on the inner tubular surface of the outer tube 11. A part of the spindle thread portion 13 protruding from the spindle nut 12 of the inner tubular surface of the outer tube 11 enters into the inside of a housing 14 and is fixed to an outer circumferential gear 15. A pinion gear 16 meshing with the outer circumferential gear 15 and the trunk drive motor M1 having a rotation shaft rotating in synchronization with the pinion gear 16 are stored in the housing 14. As the trunk drive motor M1 rotates forward or backward, a driving force of the trunk drive motor M1 is transmitted to the spindle thread portion 13 via the pinion gear 16 and the outer circumferential gear 15, so that the spindle thread portion 13 advances or recedes with respect to the outer tube 11 inside the outer tube 11. As a result, the outer tube 11 moves between a stored position (FIG. 3) in which most of the spindle thread portion 13 is stored in the inner tubular surface of the outer tube 11 and a protruding position in which most of the spindle thread portion 13 protrudes from the inner tubular surface of the outer tube 11 (that is, the expansion/contraction drive unit 10 is expanded or contracted). The housing 14 is fixed to the wall surface of the trunk 3 of the vehicle body 2. A socket 17 having a ball receptacle 17*a* is combined in the backside of the bottom of the outer tube 11, and a ball stud (not shown) provided in the hinge member 5 of the trunk lid 4 is fitted to the ball receptacle 17*a*. In this configuration, the expansion/contraction drive unit 10 is expanded or contracted depending on a forward or backward rotation of the trunk drive motor M1, so that the trunk lid 4 is opened or closed.

The expansion/contraction drive unit 10 is switched to any one of a non-operation state (manual operation state) or an operation state (electric operation state) as an operation mode for opening or closing the trunk lid 4. In the non-operation state of the expansion/contraction drive unit 10, a regenerative brake circuit (not shown) having the trunk drive motor M1 is open-circuited, and the trunk drive motor M1 is not rotationally driven. In addition, the trunk lid 4 is not opened or closed unless an external force (such as an intentional open/close force or an external force caused by wind or rain) is applied. In the operation state of the expansion/contraction drive unit 10, the regenerative brake circuit (not shown) having the trunk drive motor M1 is close-circuited, and the trunk drive motor M1 rotationally drives the trunk lid 4 to be opened or closed. Therefore, the trunk lid 4 is automatically opened or closed even when an operator does not press the trunk lid 4.

Figure 4:
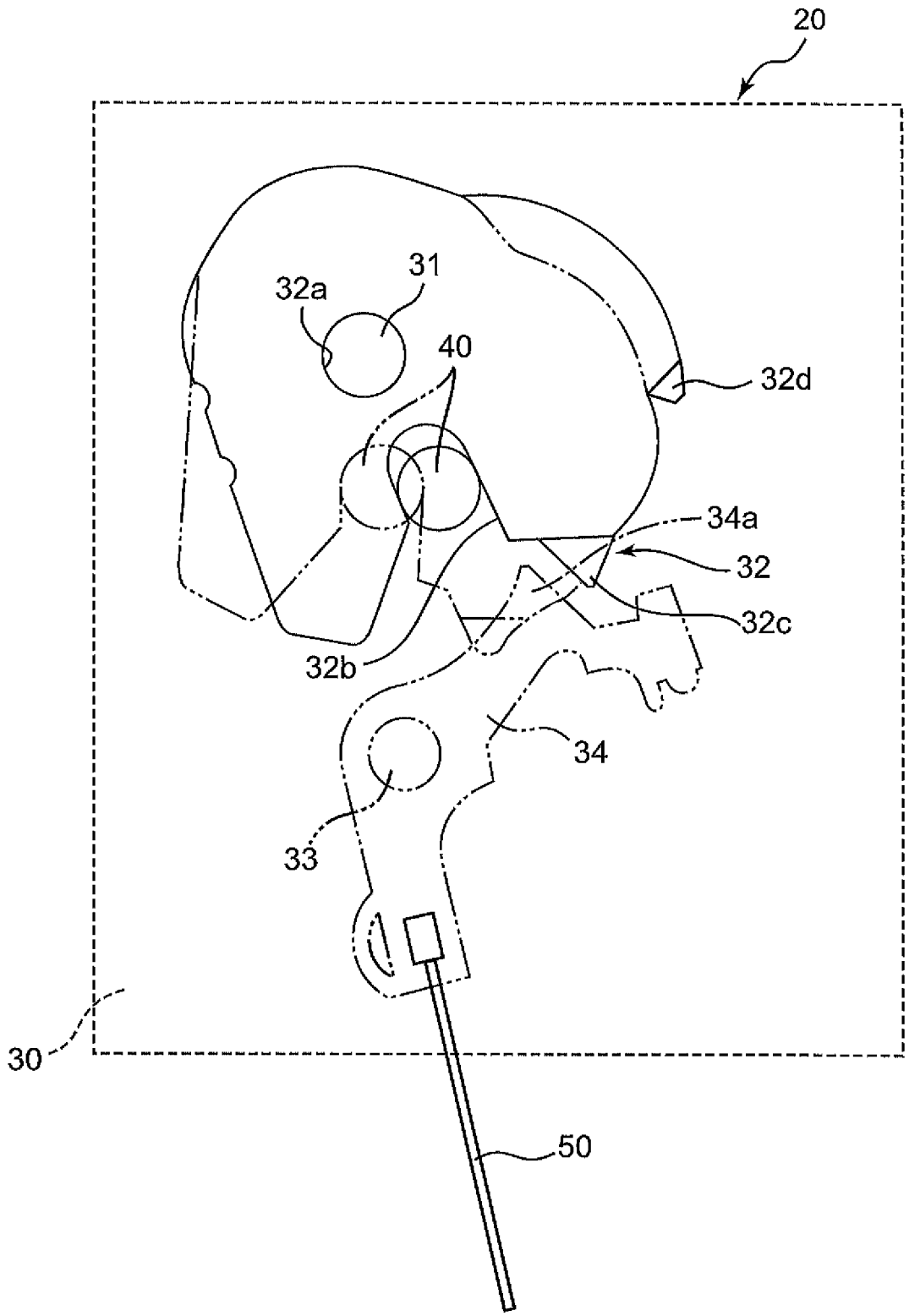
FIG. 4 is a conceptual diagram illustrating a configuration of a closer drive mechanism.

As illustrated in FIGS. 1 and 4, the power trunk lid 1 has a closer drive mechanism 20 that drives the trunk lid 4 between a half latch position and a full latch position. The closer drive mechanism 20 has a lock system 30 provided in the trunk lid 4 and a striker 40 provided on a rim of the trunk 3 of the vehicle body 2. Note that a positional relationship between the lock system 30 and the striker 40 may be reversed. That is, the lock system 30 may be provided on the rim of the trunk 3 of the vehicle body 2, and the striker 40 may be provided in the trunk lid 4.

As illustrated in FIG. 4, the lock system 30 has a hook 32 coupled to a rotation shaft member 31 and a pawl 34 rotatable around the rotation shaft member 33.

The hook 32 has a rotation support hole 32*a* supported rotatably with respect to the rotation shaft member 31, a striker holding groove (groove) 32*b*, a full latch engagement portion 32*c*, and a half latch engagement portion 32*d*. The striker holding groove 32*b* is insertable into the striker 40. The hook 32 is biased rotatably in a clockwise direction in FIG. 4 by a spring (not shown). The hook 32 is rotatable between an unlock position (counterclockwise rotation position indicated by a solid line in FIG. 4) in which the striker 40 is insertable into the striker holding groove 32*b* and a lock position (clockwise rotation position indicated by a two-dotted chain line in FIG. 4) in which the striker 40 is inhibited from being released from the striker holding groove 32*b*.

The pawl 34 has a lock portion 34*a* that can be locked to or unlocked from the full latch engagement portion 32*c* and the half latch engagement portion 32*d* of the hook 32. The pawl 34 is rotatable between an engagement position (counterclockwise rotation position in FIG. 4) in which the hook 32 is inhibited from being rotated in the unlock direction as the full latch engagement portion 32*c* of the hook 32 located in the lock position is engaged with the lock portion 34*a*, and a non-engagement position (clockwise rotation position in FIG. 4) in which the lock portion 34*a* is not engaged with the full latch engagement portion 32*c* of the hook 32. The pawl 34 is rotatably biased in the counterclockwise direction (engagement position of the pawl 34) in FIG. 4 by a spring (not shown).

Each of the hook 32, the pawl 34, and the striker 40 described above holds the trunk lid 4 in the half latch position and the full latch position, respectively.

The closer drive mechanism 20 has a closer drive motor M2 that rotationally drives the hook 32 forward or backward (FIG. 1). The closer drive mechanism 20 is driven between a half latch state and a full latch state as the closer drive motor M2 is rotated forward or backward.

Herein, the "half latch position of the trunk lid 4" refers to an intermediate opened position of the trunk lid 4 while the closer drive mechanism 20 has a half latch state, and the "full latch position of the trunk lid 4" refers to a fully closed position of the trunk lid 4 while the closer drive mechanism 20 has a full latch state. In addition, an "arbitrary opened position (including a fully opened position)" refers to an arbitrary opened position of the trunk lid 4 (including a fully opened position) while the closer drive mechanism 20 has a released state.

When the trunk lid 4 is located in the full latch position, the closer drive mechanism 20 has a full latch state in which the striker 40 is engaged with the striker holding groove 32*b* of the hook 32, and the full latch engagement portion 32*c* of the hook 32 is engaged with the lock portion 34*a* of the pawl 34.

In a case where the trunk lid 4 is opened from the full latch position by driving the closer drive motor M2, the pawl 34 is rotated in the clockwise direction in FIG. 4 as the hook 32 is rotated in the counterclockwise direction in FIG. 4. As a result, the engagement between the full latch engagement portion 32*c* and the lock portion 34*a* is released. Then, the hook 32 is rotated slightly in the clockwise direction by a biasing force of a spring (not shown), so that the lock portion 34*a* is engaged with the half latch engagement portion 32*d*. This position is the half latch position (half latch state) of the trunk lid 4 using the closer drive mechanism 20.

In a case where the trunk lid 4 is opened from the half latch position by driving the closer drive motor M2, the pawl 34 is rotated in the clockwise direction in FIG. 4 as the hook 32 is rotated in the counterclockwise direction in FIG. 4. As a result, the engagement between the lock portion 34*a* and the half latch engagement portion 32*d* is released. Then, the hook 32 is rotated slightly in the clockwise direction by a biasing force of a spring (not shown), so that the striker 40 is disengaged from the striker holding groove 32*b* of the hook 32. That is, the closer drive mechanism 20 has a released state.

Figure 5:
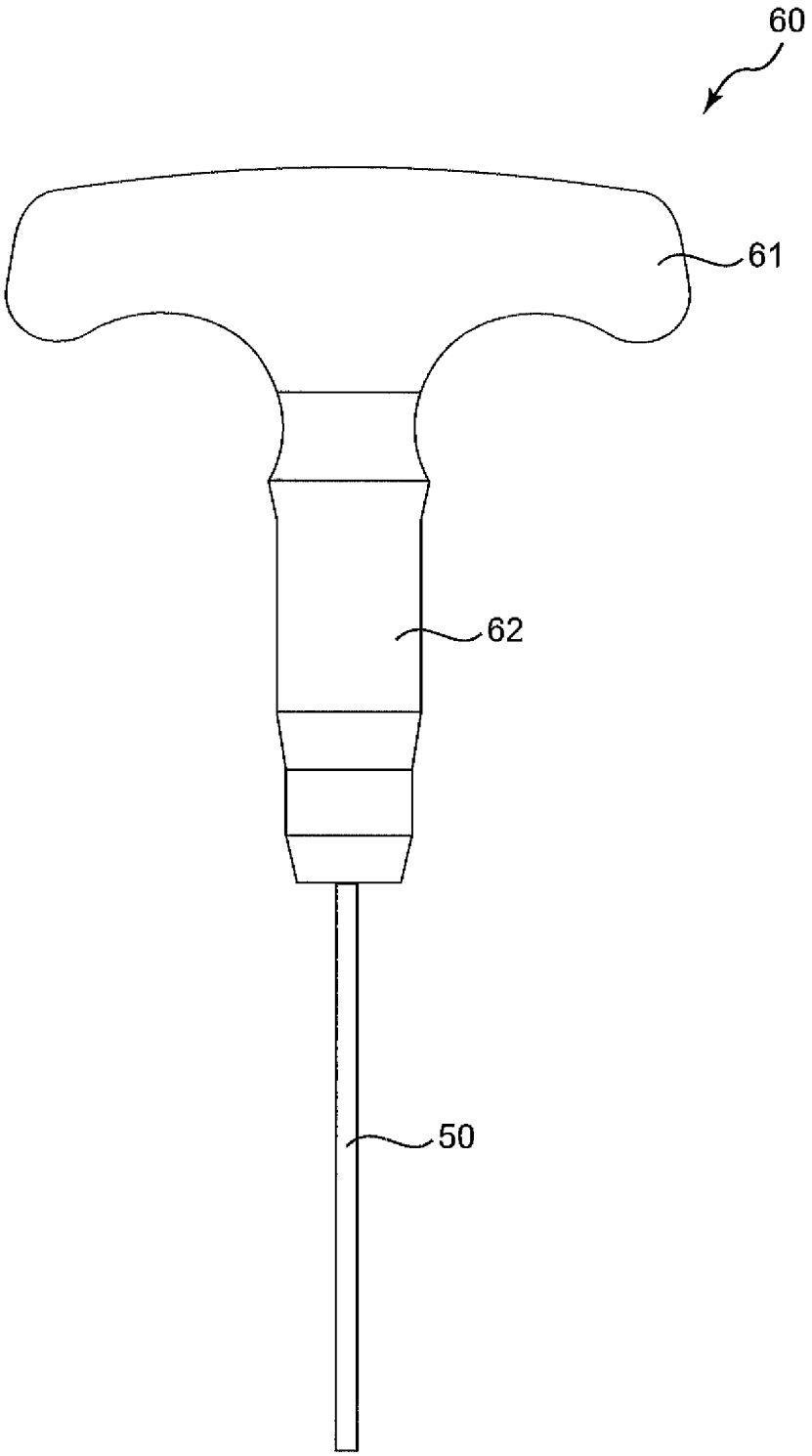
FIG. 5 is a conceptual diagram illustrating a configuration of an emergency release lever.

As illustrated in FIGS. 4 and 5, an emergency release lever 60 is connected to the pawl 34 of the lock system 30 via a connection cable (connection member) 50. The emergency release lever 60 is held on a wall surface of the trunk 3 of the vehicle body 2 and can be manipulated from the inner side of the trunk 3. If the trunk lid 4 is erroneously closed while a person exists in the trunk 3 of the vehicle body 2, the trapped person is allowed to release the lock system 30 and open the trunk lid 4 by pulling the emergency release lever 60 inside the trunk 3 of the vehicle body 2.

As illustrated in FIG. 5, the emergency release lever 60 has a generally T-shape having a lever body 61 extending in one direction (left-right direction in FIG. 5) and a lock system interlocking body 62 extending in the other direction (vertical direction in FIG. 5) from a middle part of the extending direction of the lever body 61. A connection cable 50 is connected to an end of the lock system interlocking body 62. The lever body 61 may be formed of a phosphorescent resin material containing a phosphorescent material so as to be visually recognizable in a dark place. The lock system interlocking body 62 may be formed of a non-phosphorescent resin material having a high mechanical strength and inexpensive cost lower than that of the lever body 61. Note that the lever body 61 and the lock system interlocking body 62 of the emergency release lever 60 may not be formed of different materials but may be integrated with each other using the same material.

The emergency release lever 60 is manipulatable between an initial position (first position) and a pulled position (second position) pulled from the initial position (first position). The emergency release lever 60 is biased toward the initial position (first position) by being attracted by the connecting cable 50 by virtue of the biasing force applied to the pawl 34. In a case where the emergency release lever 60 is placed in the initial position (first position), the pawl 34 is placed in the engagement position, and the lock portion 34*a* of the pawl 34 is engaged with the full latch engagement portion 32*c* of the hook 32, so that the trunk lid 4 is locked. In a case where the emergency release lever 60 is pulled from the initial position (first position) to the pulled position (second position), the pawl 34 is placed in the non-engagement position, and the lock portion 34*a* of the pawl 34 is disengaged from the full latch engagement portion 32*c* of the hook 32, so that the trunk lid 4 is unlocked.

Figure 6:
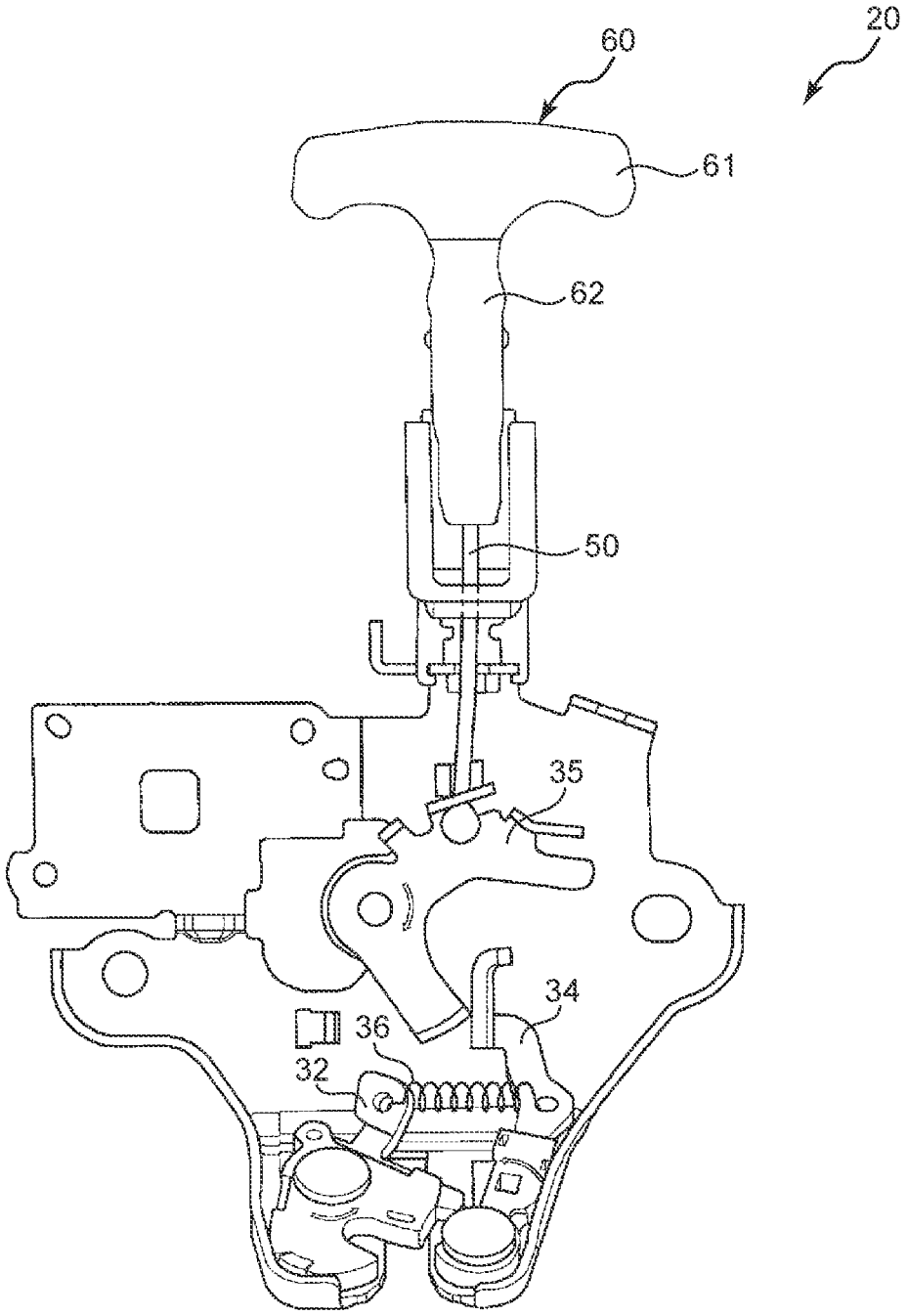
FIG. 6 is a conceptual diagram illustrating another configuration of the closer drive mechanism.

FIG. 6 illustrates another configuration of the closer drive mechanism 20. In the closer drive mechanism 20 of FIG. 6, the connection cable 50 is not directly interlocked with the pawl 34, but is indirectly interlocked with the pawl 34 using an open lever 35. The emergency release lever 60 and the open lever 35 are connected to each other by the connection cable 50, and the open lever 35 is rotationally biased in the clockwise direction in FIG. 6 by a biasing means (not shown). As a result, the emergency release lever 60 is biased toward the initial position (first position). As the emergency release lever 60 is pulled from the initial position (first position) to the pulled position (second position), the open lever 35 is rotated in the counterclockwise direction in FIG. 6 and lifts the pawl 34, so that the pawl 34 is pivoted from the engagement position with the hook 32 to the non-engagement position. Basic functions of the hook 32 and the pawl 34 are similar to those described in conjunction with FIG. 4, and they will not be described here. The hook 32 and the pawl 34 are connected to each other with a coil spring 36.

As illustrated in FIGS. 4 to 6, preferably, the connection cable (connecting member) 50 is connected to the emergency release lever 60, and has a function of directly or indirectly pivoting the pawl 34 from the engagement position with the hook 32 to the non-engagement position by manipulating the emergency release lever 60 from the initial position (first position) to the pulled position (second position).

The inventors made diligent studies and found that, in a case where the batteries of the trunk drive motor M1 and/or the closer drive motor M2 are bulged out while the trunk lid 4 is locked, the trunk lid 4 does not pop up due to a holding force (sliding resistance) of the expansion/contraction drive unit 10, and the striker holding groove 32*b* of the hook 32 is not released from the striker 40, so that the trunk lid 4 is not opened even by pulling the emergency release lever 60 from the initial position (first position) to the pulled position (second position). That is, the striker holding groove 32*b* of the hook 32 is not released from the striker 40 and still stays even by pulling the emergency release lever 60 to the pulled position (second position) to disengage the lock portion 34*a* of the pawl 34 from the full latch engagement portion 32*c* of the hook 32. Therefore, the emergency release lever 60 returns to the initial position (first position) immediately after the emergency release lever 60 is released, and it is difficult to re-engage the lock portion 34*a* of the pawl 34 with the full latch engagement portion 32*c* of the hook 32 and open the trunk lid 4. Such a problem similarly applies to a case were the trunk lid 4 does not pop up, and the striker holding groove 32*b* of the hook 32 is not released from the striker 40, so that the trunk lid 4 is not opened due to freezing in a cold weather or the like.

In order to address the aforementioned problem, the inventors conceived an "anti-return mechanism" capable of preventing the emergency release lever 60 from returning from the pulled position (second position) to the initial position (first position) when the emergency release lever 60 is pulled (manipulated) from the initial position (first position) to the pulled position (second position). Since the lock portion 34*a* of the pawl 34 is prevented from re-engaging with the full latch engagement portion 32*c* of the hook 32 by the "anti-return mechanism", it is possible to open the trunk lid 4 by applying an external force from the inside and/or outside of the trunk 3 of the vehicle body 2 to lift the trunk lid 4. In the following description, specific modes of the "anti-return mechanism" will be described.

<<First Specific Mode of Anti-Return Mechanism>>

Figure 7A:
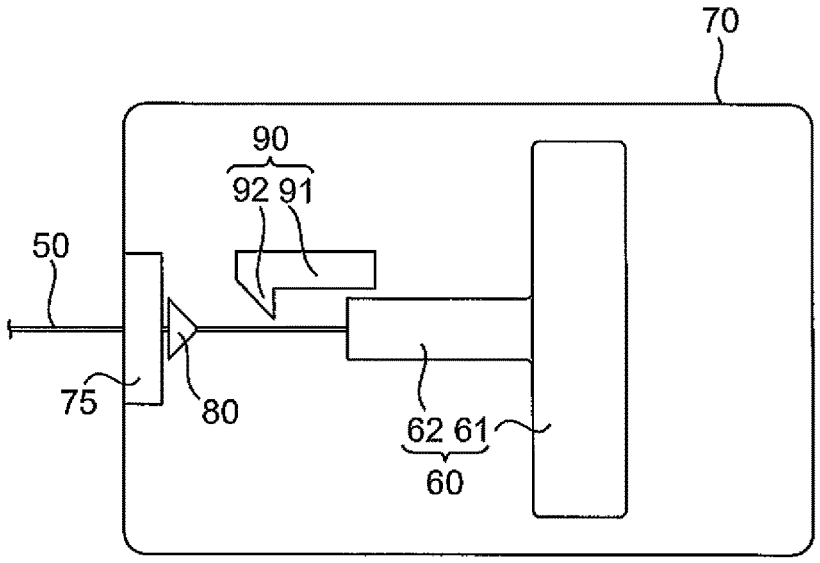
FIGS. 7A to 7C are conceptual diagrams illustrating a first specific mode of an anti-return mechanism.
Figure 7B:
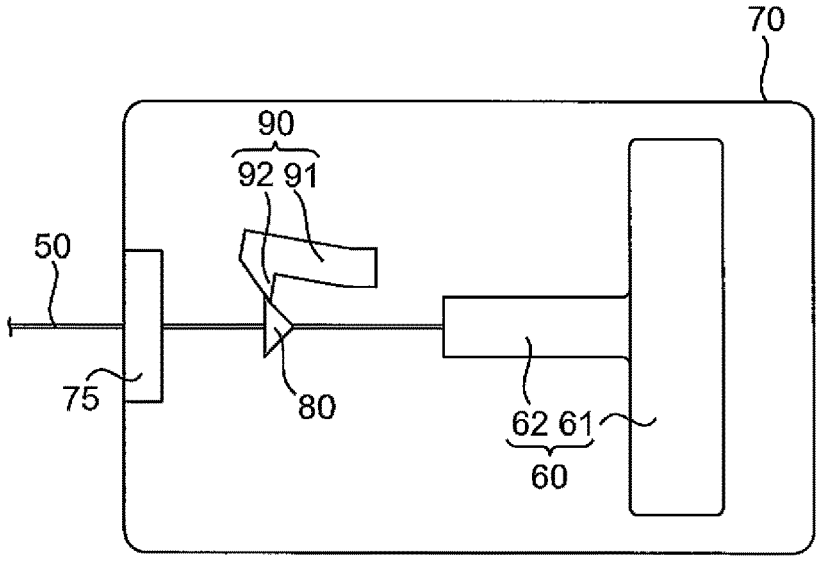
Figure 7C:
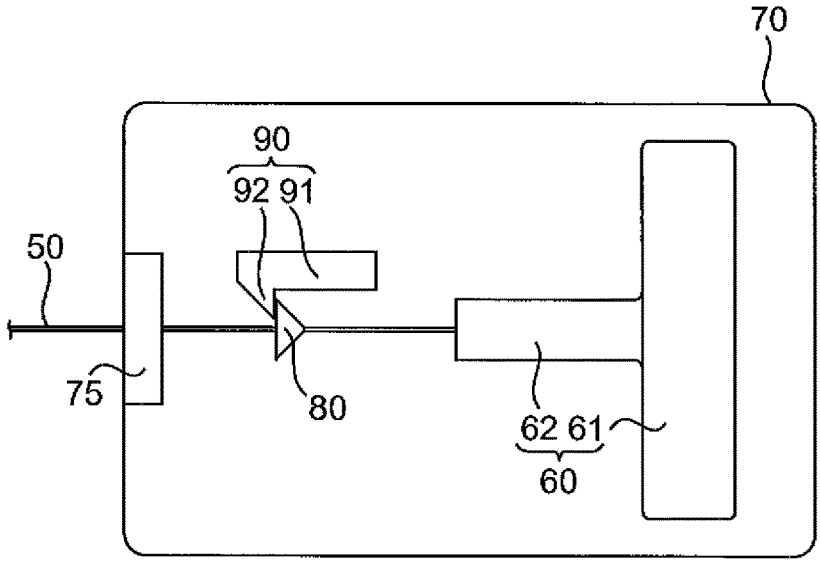

FIGS. 7A to 7C are conceptual diagrams illustrating a first specific mode of the anti-return mechanism. The emergency release lever 60 is stored in the lever storage member (housing member) 70 provided on the wall surface of the trunk 3 of the vehicle body 2. The lever storage member 70 stores (houses) the emergency release lever 60 in the initial position (first position). The lever storage member 70 has a cable support wall 75 that telescopably supports the connection cable 50 connected (interlocked) to the lock system interlocking body 62.

A part of the connection cable 50 placed between the lock system interlocking body 62 and the cable support wall 75 supports the engagement protrusion (engagement portion) 80. The engagement protrusion 80 has a conical shape widening from the lock system interlocking body 62 toward the cable support wall 75. The lever storage member 70 is placed in a later side of the connection cable 50 to support the elastic engagement claw (engagement target portion) 90. The elastic engagement claw 90 includes a main body 91 extending approximately in parallel with the lock system interlocking body 62 and a hook-shaped portion 92 extending from the main body 91 to a connecting wire 50.

FIG. 7A illustrates a state in which the emergency release lever 60 is placed in the initial position (first position). In the state of FIG. 7A, the engagement protrusion 80 is not engaged with the hook-shaped portion 92 of the elastic engagement claw 90. As the emergency release lever 60 is pulled from the initial position (first position) to the pulled position (second position) as illustrated in FIG. 7B, the conical surface of the engagement protrusion 80 elastically deforms the hook-shaped portion 92 of the elastic engagement claw 90 so as to be pushed laterally. Then, as illustrated in FIG. 7C, a bottom face of the engagement protrusion 80 is engaged with the hook-shaped portion 92 of the elastic engagement claw 90 elastically returning to a free state, so that the emergency release lever 60 is maintained in the pulled position (second position). That is, by using the engagement protrusion 80 and the elastic engagement claw 90 as the "anti-return mechanism", it is possible to prevent the emergency release lever 60 from returning from the pulled position (second position) to the initial position (first position) when the emergency release lever 60 is pulled from the initial position (first position) to the pulled position (second position).

<<Second Specific Mode of Anti-Return Mechanism>>

FIGS. 8A to 8D and 9A to 9B are conceptual diagrams illustrating a second specific mode of the anti-return mechanism. Like reference numerals denote like elements as in the first specific mode described above, and they will not be described repeatedly.

A compression spring (elastic member) 100 is supported in the vicinity of a part of the connection cable 50 between the lock system interlocking body 62 and the cable support wall 75. The lever storage member 70 has a pair of interlocking body holding portions 110 positioned in the outer circumference of the lock system interlocking body 62 of the emergency release lever 60 to hold the lock system interlocking body 62. The lever storage member 70 has a pair of locking claws 120 locked to a flat plane (face opposite to the lock system interlocking body 62) of the main body 61 of the emergency release lever 60 to maintain the compression spring 100 in a compressed state.

Figure 8A:
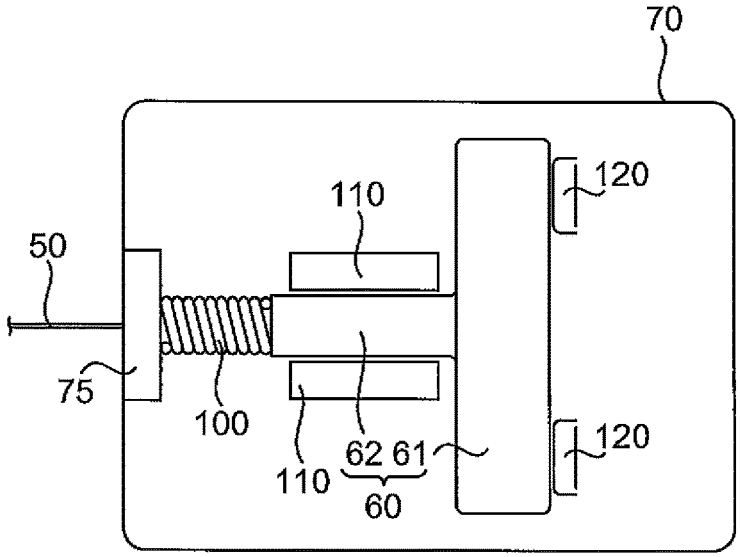
FIGS. 8A to 8D are first conceptual diagrams illustrating a second specific mode of the anti-return mechanism.
Figure 8B:
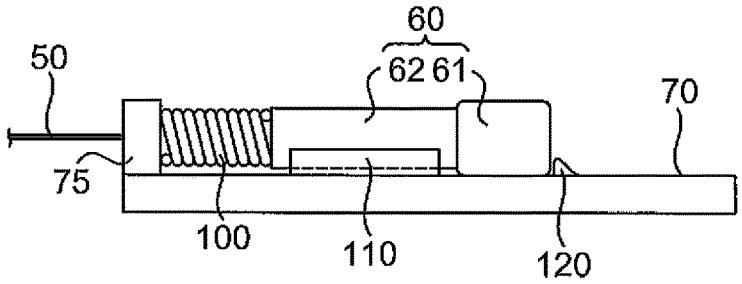
Figure 8C:
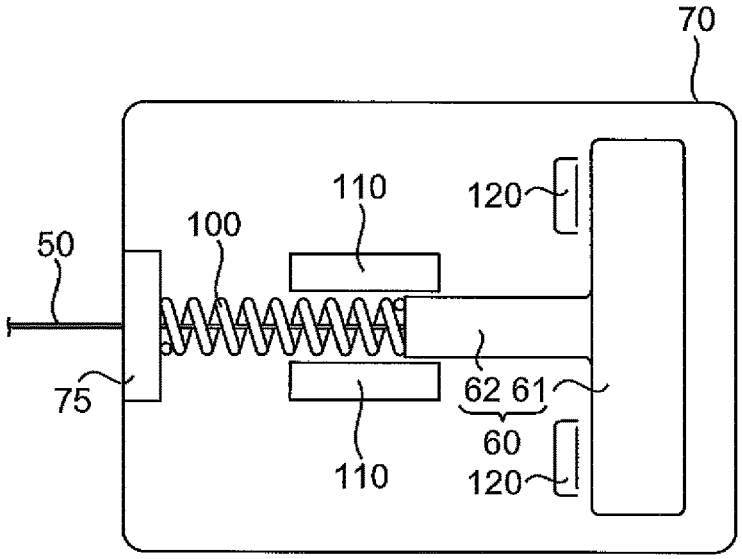
Figure 8D:
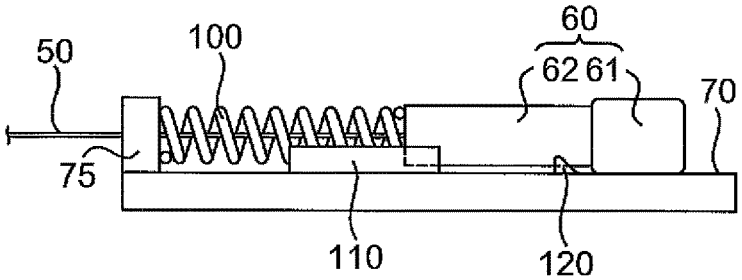
Figure 9A:
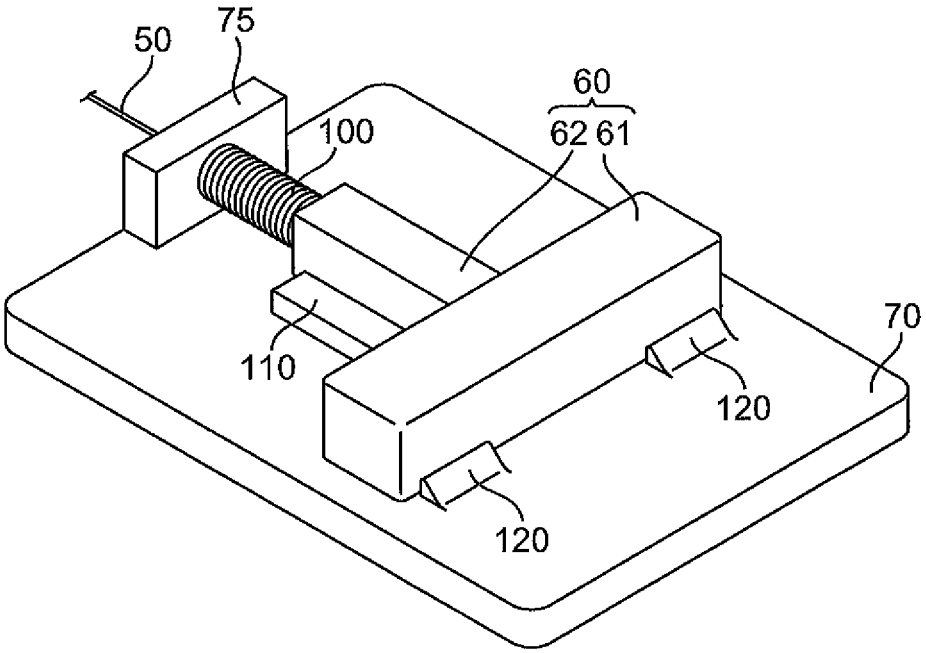
FIGS. 9A to 9B are second conceptual diagrams illustrating the second specific mode of the anti-return mechanism.
Figure 9B:
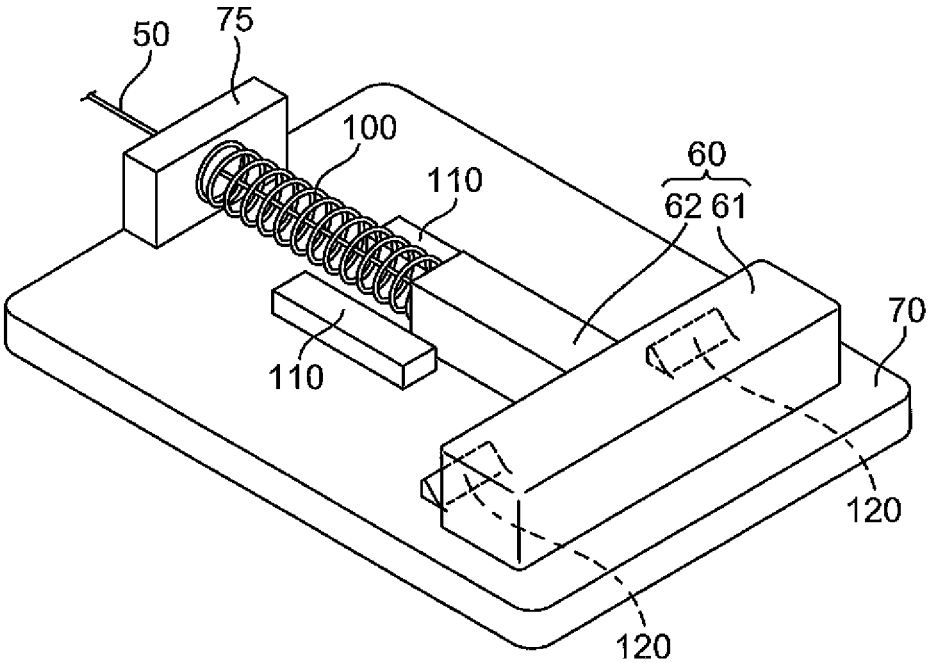

FIGS. 8A, 8B, and 9A illustrate a state in which the emergency release lever 60 is in the initial position (first position). In the state of FIGS. 8A, 8B, and 9A, the flat plane (face opposite to the lock system interlocking body 62) of the main body 61 of the emergency release lever 60 is locked to a pair of locking claws 120, so that the compression spring 100 is maintained in a compressed state. As illustrated in FIGS. 8C, 8D, and 9B, when the emergency release lever 60 is lifted, locking between the flat plane (face opposite to the lock system interlocking body 62) of the main body 61 of the emergency release lever 60 and a pair of locking claws 120 is released (unlocked), and the compression spring 100 has a free state, so that the emergency release lever 60 is maintained in the pulled position (second position). In this state, a pair of locking claws 120 are placed in both sides of the lock system interlocking body 62 of the emergency release lever 60. In this manner, by the compression spring 100 and a pair of locking claws 120 serving as the "anti-return mechanism", the emergency release lever 60 is prevented from returning to the initial position (first position) from the pulled position (second position) when the emergency release lever 60 is pulled from the initial position (first position) to the pulled position (second position).

<<Third Specific Mode of Anti-Return Mechanism>>

FIGS. 10A to 10D are conceptual diagrams illustrating a third specific mode of the anti-return mechanism. Like reference numerals denote like elements as in the first specific mode described above, and they will not be described repeatedly.

An extension spring (elastic member) 130 is supported in the vicinity of a part of the connection cable 50 between the lock system interlocking body 62 and the cable support wall 75. The lever storage member 70 has a pair of interlocking body holding portions 110 placed in the outer circumference of the lock system interlocking body 62 of the emergency release lever 60 to hold the lock system interlocking body 62. The lever storage member 70 has a pair of first locking claws 140 locked to faces of the main body 61 of the emergency release lever 60 placed in both sides of the lock system interlocking body 62 to maintain the extension spring 130 in an approximately free state (perfect free state or slightly pulled state). The lever storage member 70 has a pair of second locking claws 150 locked to faces of the main body 61 of the emergency release lever 60 placed in both sides of the lock system interlocking body 62 to maintain the extension spring 130 in the pulled state.

Figure 10A:
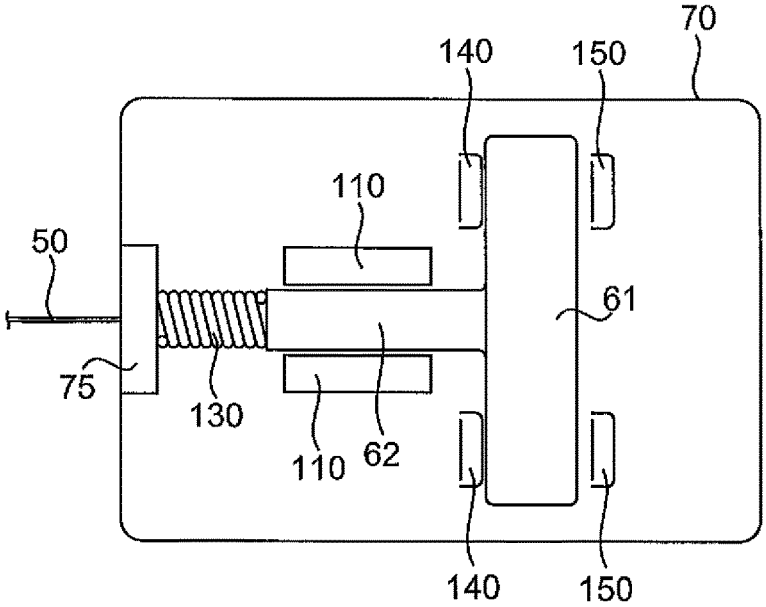
FIGS. 10A to 10D are conceptual diagrams illustrating a third specific mode of the anti-return mechanism.
Figure 10B:
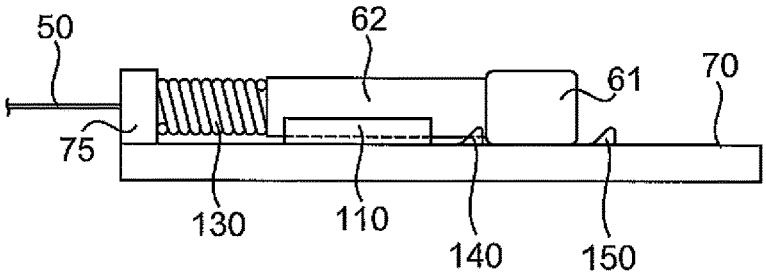
Figure 10C:
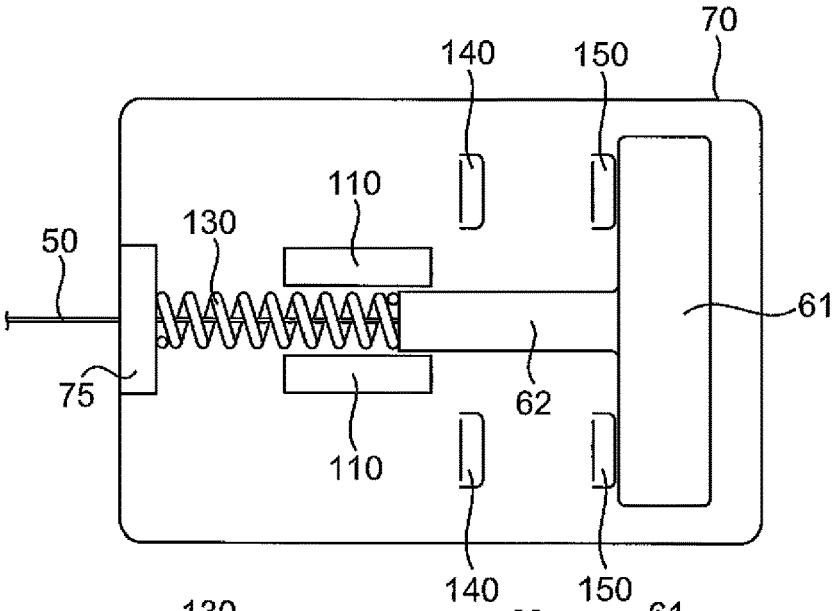
Figure 10D:
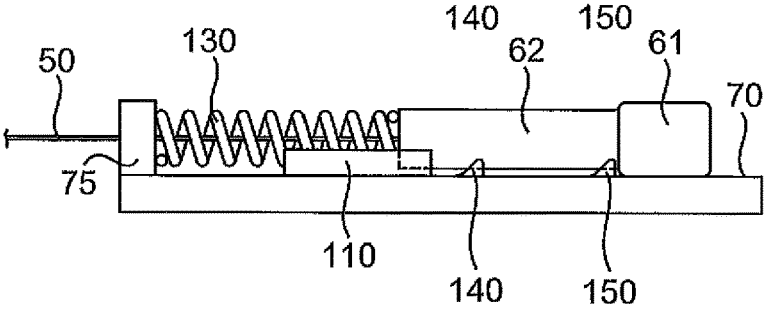

FIGS. 10A and 10B illustrate a state in which the emergency release lever 60 is in the initial position (first position). In the state of FIGS. 10A and 10B, the faces of the main body 61 of the emergency release lever 60 placed in both sides of the lock system interlocking body 62 are locked to a pair of first locking claws 140, so that the extension spring 130 is maintained in an approximately free state (perfect free state or slightly pulled state). As illustrated in FIGS. 10C and 10D, when the emergency release lever 60 is pulled from the initial position (first position) to the pulled position (second position) to lock the faces of the main body 61 of the emergency release lever 60 placed in both sides of the lock system interlocking body 62 to a pair of second locking claws (engagement target portion) 150, the extension spring 130 is in the pulled state, and the emergency release lever 60 is maintained in the pulled position (second position). In this manner, when the emergency release lever 60 is pulled from the initial position (first position) to the pulled position (second position) by the extension spring 130 and a pair of second locking claws 150 serving as the "anti-return mechanism", the emergency release lever 60 is prevented from returning to the initial position (first position) from the pulled position (second position).

Note that the first to third specific modes of the anti-return mechanism described above are for illustrative purposes, and their configurations may be free. That is, various changes in the design may be possible for the specific modes of the "anti-return mechanism" as long as the emergency release lever 60 is prevented from returning to the initial position (first position) from the pulled position (second position) when the emergency release lever 60 is pulled (manipulated) from the initial position (first position) to the pulled position (second position).

REFERENCE SIGNS LIST

1 power trunk lid (emergency release device of lock system)
2 vehicle body
3 trunk (trunk opening)
4 trunk lid (lid)
5 hinge member
5*a* pivot shaft
6 stopper member
7 weather strip
10 expansion/contraction drive unit
11 outer tube
12 spindle nut
13 spindle thread portion
14 housing
15 outer circumferential gear
16 pinion gear
17 socket
17*a* ball receptacle
20 closer drive mechanism
30 lock system
31 rotation shaft member
32 hook
32*a* rotation support hole
32*b* striker holding groove (groove)
32*c* full latch engagement portion
32*d* half latch engagement portion
33 rotation shaft member
34 pawl
34*a* lock portion
35 open lever
36 coil spring
40 striker
50 connection cable (connecting member)
60 emergency release lever
61 lever body
62 lock system interlocking body
70 lever storage member (housing member)
75 cable support wall
80 engagement protrusion (anti-return mechanism, engagement portion)
90 elastic engagement claw (anti-return mechanism, engagement target portion)
91 main body
92 hook-shaped portion
100 compression spring (anti-return mechanism, elastic member)
110 interlocking body holding portion
120 locking claw (anti-return mechanism)
130 extension spring (anti-return mechanism, elastic member)
140 first locking claw
150 second locking claw (anti-return mechanism, engagement target portion)
M1 trunk drive motor
M2 closer drive motor

The invention claimed is:

1. An emergency release device of a lock system provided in one of a rim of a trunk formed in a vehicle body and a lid that opens or closes the trunk and is locked to or unlocked from a striker provided in the other one, the emergency release device comprising:

a hook having a groove where the striker is insertable, the hook being rotatable from an unlock position where the striker is insertable into the groove to a lock position in which the striker is inhibited from being released from the groove;

a pawl rotatable between an engagement position where the pawl is engaged with the hook placed in the lock position to inhibit rotation of the hook to an unlock direction and a non-engagement position where the pawl is not engaged with the hook, the pawl being biased toward the engagement position;

an emergency release lever manipulatable from an inner side of the trunk between a first position for placing the pawl in the engagement position and a second position for placing the pawl in the non-engagement position, the emergency release lever being biased toward the first position; and an anti-return mechanism configured to prevent the emergency release lever from returning from the second position to the first position when the emergency release lever is manipulated from the first position to the second position, wherein the lock system has a housing member configured to house the emergency release lever in the first position and a connecting member connected to the emergency release lever to directly or indirectly pivot the pawl from the engagement position to the non-engagement position by manipulating the emergency release lever from the first position to the second position, the anti-return mechanism has an elastic member supported by the connecting member and provided between the housing member and the emergency release lever, the elastic member is in a compressed state when the emergency release lever is in the first position, the elastic member is in a free state and the emergency release lever is held in the second position after the emergency release lever is manipulated from the first position to the second position, the connecting member comprises a connection cable connected to the emergency release lever, the elastic member comprises a spring which is supported in a vicinity of a part of the connection cable, the connection cable and the spring comprise discrete members, when the emergency release lever is in the first position, the spring does not apply the force to the pawl, when the emergency release lever is in the second position, the spring applies tension force to the connection cable, which causes the pawl to be held at the non-engagement position, opposing a biasing force returning the pawl to the engagement position.

2. The emergency release device of a lock system according to claim 1, wherein the spring and the connection cable are coaxially arranged over a length of the spring.

3. The emergency release device of a lock system according to claim 1, wherein the spring comprises a coil spring, and applies tension force to the connection cable in going from the compressed state to the free state.

4. The emergency release device of a lock system according to claim 1, wherein the spring comprises a coil spring through which the connection cable passes.

* * * * *